US009844950B2

(12) United States Patent
Kondo et al.

(10) Patent No.: US 9,844,950 B2
(45) Date of Patent: Dec. 19, 2017

(54) THERMAL HEAD AND THERMAL PRINTER PROVIDED WITH SAME

(71) Applicant: KYOCERA Corporation, Kyoto-shi, Kyoto (JP)

(72) Inventors: Yoshiyuki Kondo, Kirishima (JP); Shoji Hirose, Kirishima (JP); Yoichi Moto, Okaya (JP)

(73) Assignee: Kyocera Corporation, Kyoto (JP)

( * ) Notice: Subject to any disclaimer, the term of this patent is extended or adjusted under 35 U.S.C. 154(b) by 12 days.

(21) Appl. No.: 14/914,087

(22) PCT Filed: Aug. 23, 2014

(86) PCT No.: PCT/JP2014/072073
§ 371 (c)(1),
(2) Date: Feb. 24, 2016

(87) PCT Pub. No.: WO2015/029913
PCT Pub. Date: Mar. 5, 2015

(65) Prior Publication Data

US 2016/0207327 A1 Jul. 21, 2016

(30) Foreign Application Priority Data

Aug. 26, 2013 (JP) ..... 2013-174644

(51) Int. Cl.
*B41J 2/335* (2006.01)

(52) U.S. Cl.
CPC ..... *B41J 2/3352* (2013.01); *B41J 2/3351* (2013.01); *B41J 2/3353* (2013.01); *B41J 2/3354* (2013.01);
(Continued)

(58) Field of Classification Search
CPC .... B41J 2/3351; B41J 2/33515; B41J 2/3353; B41J 2/3355; B41J 2/3357
See application file for complete search history.

(56) References Cited

U.S. PATENT DOCUMENTS 6,201,558 B1 * 3/2001 Shirakawa ..... B41J 2/3351 347/208
6,303,874 B1 * 10/2001 Muramatsu ..... G02F 1/133308 174/260
9,365,057 B1 * 6/2016 Seino ..... B41J 11/04

FOREIGN PATENT DOCUMENTS

JP 63-179764 A 7/1988
JP 04-255362 A 9/1992
(Continued)

OTHER PUBLICATIONS

International Search Report (PCT/ISA/210) dated Nov. 25, 2014, issued for International Patent Application No. PCT/JP2014/072073.

*Primary Examiner* — Lamson Nguyen
(74) *Attorney, Agent, or Firm* — Volpe and Koenig, P.C.

(57) ABSTRACT

A thermal head includes a substrate, a heat-generating portion disposed on the substrate, electrodes disposed on the substrate and electrically connected to the heat-generating portion, a driver IC disposed on the substrate and electrically connected to the electrodes, and a covering member covering the driver IC. In plan view, a center line of the driver IC extending in a main scanning direction and a highest position of the covering member are located farther form the heat-generating portion than a center line of the covering member extending in the main scanning direction.

20 Claims, 13 Drawing Sheets

(52) U.S. Cl.
CPC ..... *B41J 2/3355* (2013.01); *B41J 2/3357* (2013.01); *B41J 2/33515* (2013.01)

(56) References Cited

FOREIGN PATENT DOCUMENTS

| | | | |
|---|---|---|---|
| JP | 07-256914 | A | 10/1995 |
| JP | 08-281990 | A | 10/1996 |
| JP | 2000-296633 | A | 10/2000 |
| JP | 2003-220725 | A | 8/2003 |
| JP | 2004-230582 | A | 8/2004 |
| JP | 2007-185830 | A | 7/2007 |

* cited by examiner

THERMAL HEAD AND THERMAL PRINTER PROVIDED WITH SAME

TECHNICAL FIELD

The present invention relates to a thermal head and a thermal printer provided with the thermal head.

BACKGROUND ART

Various thermal heads have been proposed as printing devices for facsimile machines, video printers, and the like. For example, a known thermal head includes a substrate, a heat-generating portion disposed on the substrate, an electrode disposed on the substrate and electrically connected to the heat-generating portion, a driver IC disposed on the substrate and electrically connected to the electrode, and a covering member covering the driver IC (see, for example, PTL 1)

CITATION LIST

Patent Literature

PTL 1: Japanese Unexamined Patent Application Publication No. 8-281990

SUMMARY OF INVENTION

Technical Problem

However, with the thermal head described in PTL 1, a recording medium, such as thermal paper or the like, passes along a surface of the covering member, which covers the driver IC, while being in contact with the surface. Because the driver IC generates heat as the thermal head is driven, heat of the driver IC is conducted to the recording medium through the covering member, and it is probable that a printed image has a nonuniform density.

Solution to Problem

A thermal head according to an embodiment of the present invention includes a substrate, a heat-generating portion disposed on the substrate, an electrode disposed on the substrate and electrically connected to the heat-generating portion, a driver IC disposed on the substrate and electrically connected to the electrode, and a covering member covering the driver IC. In plan view, a center line of the driver IC extending in a main scanning direction is located farther than a top portion of the covering member from the heat-generating portion.

A thermal head according to another embodiment of the present invention includes a substrate, a heat-generating portion disposed on the substrate, an electrode disposed on the substrate and electrically connected to the heat-generating portion, a circuit board electrically connected to the electrode, a driver IC disposed on the circuit board and electrically connected to the electrode, and a covering member covering the driver IC. In plan view, a center line of the driver IC extending in a main scanning direction is located farther than a top portion of the covering member from the heat-generating portion.

A thermal printer according to an embodiment of the present invention includes the thermal head described above, a conveying mechanism that conveys a recording medium onto the heat-generating portion, and a platen roller that presses the recording medium against the heat-generating portion.

Advantageous Effects of Invention

With the present invention, the probability of heat of the driver IC being conducted to a recording medium can be reduced. As a result, the probability of occurrence of nonuniform density in an image printed by the thermal head can be reduced.

DESCRIPTION OF EMBODIMENTS

First Embodiment

Figure 1:
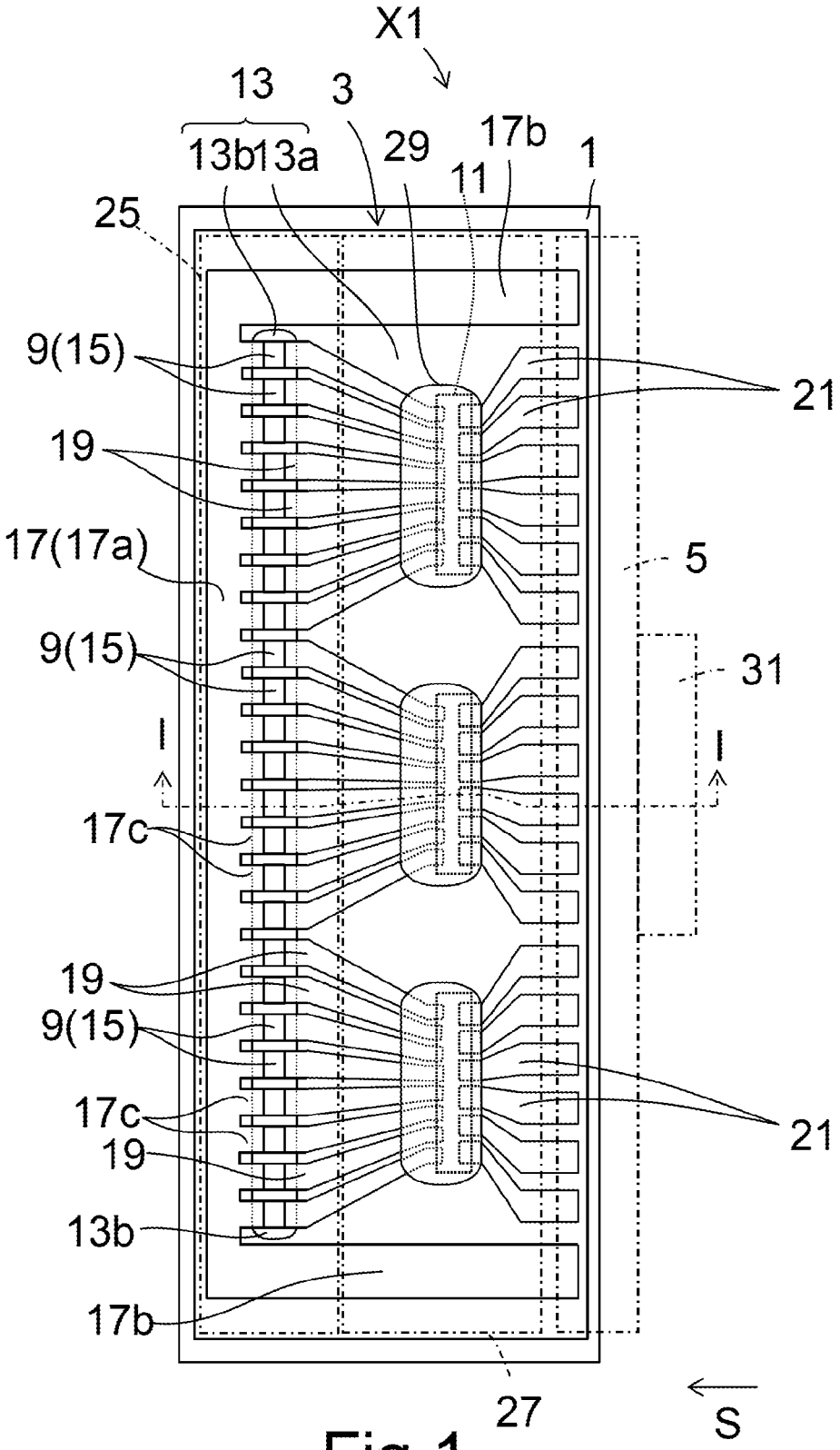
FIG. 1 is a plan view of a thermal head according to a first embodiment.

Hereinafter, a thermal head X1 will be described with reference to FIGS. 1 to 4. The thermal head X1 includes a heat sink 1, a head base body 3 disposed on the heat sink 1, and a flexible printed circuit 5 (hereinafter, referred to as "the FPC 5") connected to the head base body 3. The FPC 5 is not illustrated in FIG. 1. Instead, a region in which the FPC 5 is disposed is represented by a chain line. Likewise, a protective layer 25 and a covering layer 27, which are not illustrated, are represented by chain lines.

The heat sink 1 has a plate-like shape that is rectangular in plan view. The heat sink 1 is made of, for example, a metal material, such as copper, iron, or aluminum. The heat sink 1 has a function of dissipating a part of heat that is generated by heat-generating portions 9 of the head base body 3 and that does not contribute to printing. The head base body 3 is bonded to the upper surface of the heat sink 1 by using a double-sided tape, an adhesive, or the like (not shown).

The head base body 3 has a plate-like shape in plan view, and components of the thermal head X1 are disposed on a substrate 7 of the head base body 3. The head base body 3 has a function of performing printing on a recording medium (see FIG. 3) in accordance with an electrical signal supplied from the outside.

The FPC 5 is electrically connected to the head base body 3 and includes an insulating resin layer and a plurality of printed wires patterned in the insulating resin layer. The FPC 5 is a circuit board having a function of supplying an electric current and an electrical signal to the head base body 3. One end of each of the printed wires is exposed from the resin layer, and the other end of each of the printed wires is electrically connected to a connector 31.

The printed wires of the FPC 5 are connected to connection electrodes 21 of the head base body 3 via a bonding material 23. Thus, the head base body 3 and the FPC 5 are electrically connected to each other. Examples of the bonding material 23 include a solder and an anisotropic conductive film (ACF), which is composed of an electrically insulating resin and electrically conductive particles mixed in the resin. A reinforcing resin plate (not shown), which is made of a phenolic resin, a polyimide resin, a glass epoxy resin, or the like, may be disposed between the FPC 5 and the heat sink 1.

In the example described above, the FPC 5, which is flexible, is used as a printed circuit board. Instead, a hard circuit board may be used. Examples of a hard printed circuit board include a circuit board made from a resin substrate, such as a glass epoxy substrate or a polyimide substrate.

Hereinafter, each component of the head base body 3 will be described.

The substrate 7 is made of an electrically insulating material such as alumina ceramic, a semiconductor material such as single-crystal silicon, or the like.

A heat storage layer 13 is disposed on the upper surface of the substrate 7. The heat storage layer 13 includes a base 13*a* and a protruding portion 13*b*. The base 13*a* extends over the entire area of the upper surface of the substrate 7. The protruding portion 13*b* extends in strip-like shape in the direction in which the plurality of heat-generating portions 9 are arranged, and has a substantially semi-elliptical cross section. The protruding portion 13*b* functions to appropriately press a recording medium, which is to be printed, against the protective layer 25 disposed on the heat-generating portions 9.

The heat storage layer 13 is made of glass having low thermal conductivity and temporarily stores a part of heat generated by the heat-generating portions 9. Therefore, the heat storage layer 13 can reduce the time required to increase the temperature of the heat-generating portions 9, and functions to increase the thermal responsivity of the thermal head X1. The heat storage layer 13 is formed, for example, by applying a predetermined glass paste, which is obtained by mixing glass powder with an appropriate organic solvent, to the upper surface of the substrate 7 by using a known screen printing method or the like; and by firing the glass paste.

An electrically resistive layer 15 is disposed on the upper surface of the heat storage layer 13. A common electrode 17, individual electrodes 19, and the connection electrodes 21 are disposed on the electrically resistive layer 15. The electrically resistive layer 15 is patterned in the same shape as the common electrode 17, the individual electrodes 19, and the connection electrodes 21. The electrically resistive layer 15 has exposed regions, in which the electrically resistive layer 15 is exposed, between the common electrode 17 and the individual electrodes 19. As illustrated in FIG. 1, the exposed regions of the electrically resistive layer 15 are arranged in a row on the protruding portion 13*b* of the heat storage layer 13, and the exposed regions serve as the heat-generating portions 9. The plurality of heat-generating portions 9, which are illustrated in a simplified manner in FIG. 1 for convenience of description, are disposed, for example, at a density of 100 to 2400 dpi (dot per inch).

The electrically resistive layer 15 is made of, for example, a material having relatively high electric resistance, such as a TaN-based, TaSiO-based, TaSiNO-based, TiSiO-based, TiSiCO-based, or NbSiO-based material. Therefore, when a voltage is applied to the heat-generating portions 9, the heat-generating portions 9 generate heat by Joule heating.

Figure 2:
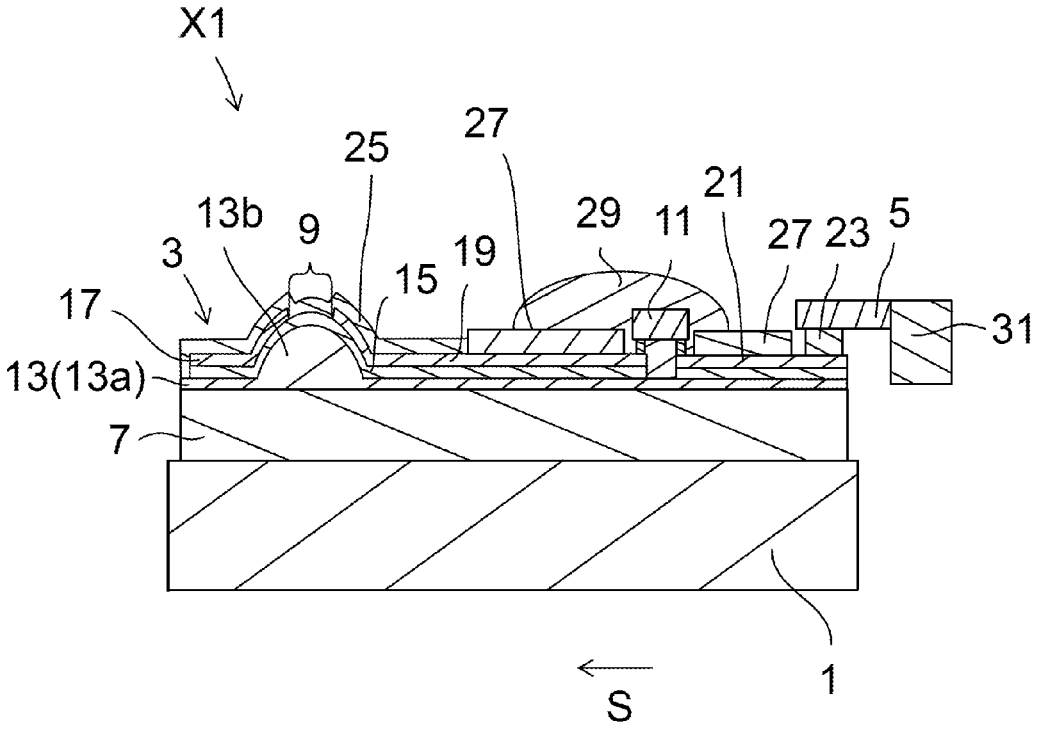
FIG. 2 is a cross-sectional view taken along line I-I of FIG. 1.

As illustrated in FIGS. 1 and 2, the common electrode 17, the plurality of individual electrodes 19, and the plurality of connection electrodes 21 are disposed on the upper surface of the electrically resistive layer 15. The common electrode 17, the individual electrodes 19, and the connection electrodes 21 are made of any one of electroconductive metals, such as aluminum, gold, silver, and copper, or made of an alloy of such metals.

The common electrode 17 includes a main wiring portion 17*a*, sub-wiring portions 17*b*, and lead portions 17*c*. The main wiring portion 17*a* is disposed so as to extend along a long side of the substrate 7. The sub-wiring portions 17*b* are disposed so as to respectively extend along one short side and the other short side of the substrate 7 and are connected to the main wiring portion 17*a*. The lead portions 17*c* are disposed so as to individually extend from the main wiring portion 17*a* toward the heat-generating portions 9 and connect the main wiring portion 17*a* and the heat-generating portions 9 to each other. One end of the common electrode 17 is connected to the plurality of heat-generating portions 9 and the other end of the common electrode 17 is connected to the FPC 5. Thus, the common electrode 17 electrically connects the FPC 5 and the heat-generating portions 9 to each other.

One end of each of the individual electrodes 19 is connected to a corresponding one of the heat-generating portions 9 and the other end of each of the individual electrodes 19 is connected to one of driver ICs 11. Thus, the individual electrodes 19 electrically connect the heat-generating portions 9 to the driver ICs 11. The individual electrodes 19 divide the plurality of heat-generating portions 9 into a plurality of groups and electrically connect the heat-generating portions 9 in each group to one of the driver ICs 11 corresponding to the group.

One end of each of the connection electrodes 21 is connected to one of the driver ICs 11, and the other end of each of the connection electrodes 21 is connected to the FPC 5. Thus, the connection electrodes 21 electrically connect the driver ICs 11 and the FPC 5 to each other. The plurality of connection electrodes 21 connected to each of the driver ICs 11 include a plurality of wires having different functions.

As illustrated in FIG. 1, the driver ICs 11 are disposed on the substrate 7 so as to correspond to each group of the plurality of heat-generating portions 9, and is connected to the other end of each of the individual electrodes 19 and the one end of each of the connection electrodes 21. The plurality of driver ICs 11 are arranged in the main scanning direction. The driver ICs 11 have a function of controlling the state of an electric current applied to the heat-generating portions 9. As each of the driver ICs 11, a switching member including a plurality of switching elements may be used.

The electrically resistive layer 15, the common electrode 17, the individual electrodes 19, and the connection electrodes 21 are formed, for example, by stacking material layers for these components successively on the heat storage layer 13 by using a known thin-film forming technique such as sputtering, and then processing the stacked body to have a predetermined pattern by using a known photoetching process or the like. The common electrode 17, the individual electrodes 19, and the connection electrodes 21 can be simultaneously formed by the same process.

As illustrated in FIGS. 1 and 2, the protective layer 25 is disposed on the heat storage layer 13 on the upper surface of the substrate 7. The protective layer 25 covers the heat-generating portions 9, a part of the common electrode 17, and a part of the individual electrodes 19. For convenience of description, the protective layer 25 is not illustrated in FIG. 1. Instead, a region in which the protective layer 25 is formed is represented by the chain line.

The protective layer 25 protects the covered areas of the heat-generating portions 9, the common electrode 17, and the individual electrodes 19 from corrosion due to adhesion of moisture or the like included in the atmosphere or from abrasion due to contact with a recording medium on which printing is to be performed. The protective layer 25 can be formed by using SiN, SiO, SiON, SiC, SiCN, diamond-like carbon, or the like. The protective layer 25 may include a single layer or multiple layers of such materials. The protective layer 25 can be formed using a thin-film forming technology, such as sputtering, or a thick-film forming technology, such as screen printing.

As illustrated in FIGS. 1 and 2, the covering layer 27 is disposed on the base 13*a* of the heat storage layer 13 on the upper surface of the substrate 7. The covering layer 27 partially covers the common electrode 17, the individual electrodes 19, and the connection electrodes 21. For convenience of description, a region in which the covering layer 27 is formed is represented by a chain line in FIG. 1.

The covering layer 27 protects the covered areas of the common electrode 17, the individual electrodes 19, and the connection electrodes 21 from oxidation due to contact with the atmosphere or from corrosion due to adhesion of moisture or the like included in the atmosphere. The covering layer 27 can be formed by using a resin material, such as an epoxy resin or a polyimide resin, and a thick-film forming technique such as screen printing.

Openings (not shown), for exposing the individual electrodes 19 and the connection electrodes 21 connected to the driver ICs 11, are formed in the covering layer 27. The individual electrodes 19 and the connection electrodes 21 are connected to the driver ICs 11 through the openings.

Referring to FIGS. 1 to 4, a covering member 29 will be described in detail.

The covering member 29 is disposed so as to cover the driver ICs 11 and is disposed so as to cover the entirety of the driver ICs 11. The covering member 29 protects the driver ICs 11 by covering the driver ICs 11. The covering member 29 also protects connection portions at which the individual electrodes 19 and the connection electrodes 21 are connected to the driver ICs 11.

The covering member 29 has a first edge 29*b* and a second edge 29*c* extending in the main scanning direction. The first edge 29*b* of the covering member 29 is disposed closer to the heat-generating portions 9, and the second edge 29*c* of the covering member 29 is disposed farther from the heat-generating portions 9.

The covering member 29 has a rectangular shape with rounded corners in plan view, and has a semi-elliptical shape having a top portion 29*a* at the center thereof in cross-sectional view. The top portion 29*a* is a portion of the covering member 29 that is located farthest from the substrate 7 in the thickness direction of the substrate 7.

Figure 4A:
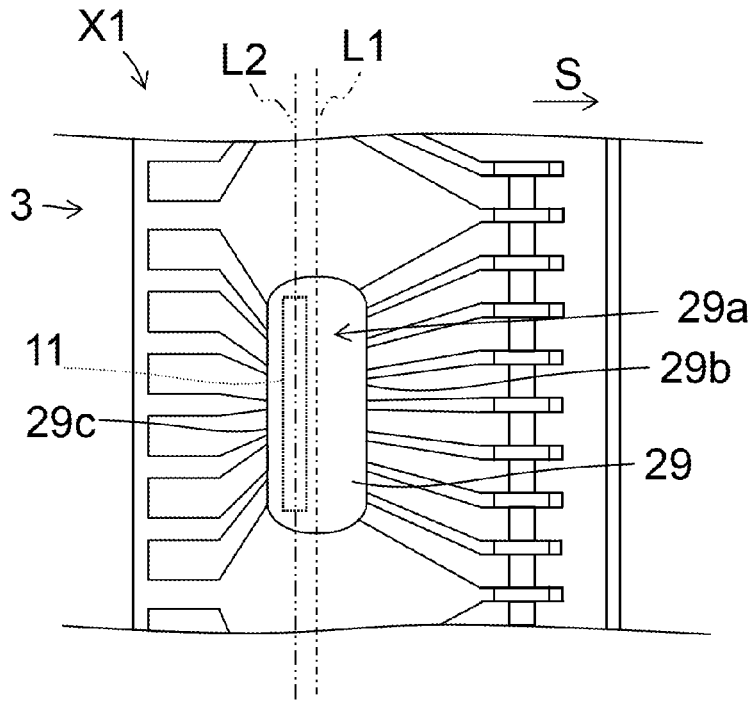
FIG. 4(*a*) is an enlarged plan view of the vicinity of a covering member, and FIG. 4(*b*) is a cross-sectional view illustrating a contact state in which a recording medium is in contact with a covering member during printing.
Figure 4B:
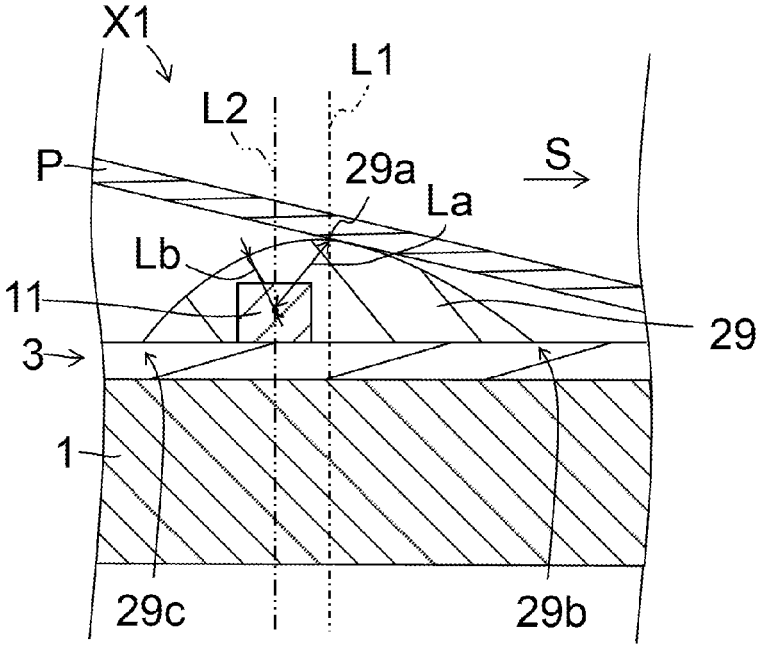

As illustrated in FIG. 4, a center line L1 of the covering member 29 extending in the main scanning direction (hereinafter, referred to as "the center line L1") passes through the top portion 29*a*. A center line L2 of each driver IC 11 extending in the main scanning direction (hereinafter, referred to as "the center line L2") is located farther than the top portion 29*a* of the covering member 29 from the heat-generating portions 9.

The center line L1 is a line that is equidistant from the first edge 29*b* and the second edge 29*c* and extends in the main scanning direction. The center line L2 is a line that is equidistant from a pair of long sides of the driver IC 11 and extends in the main scanning direction.

Figure 3:
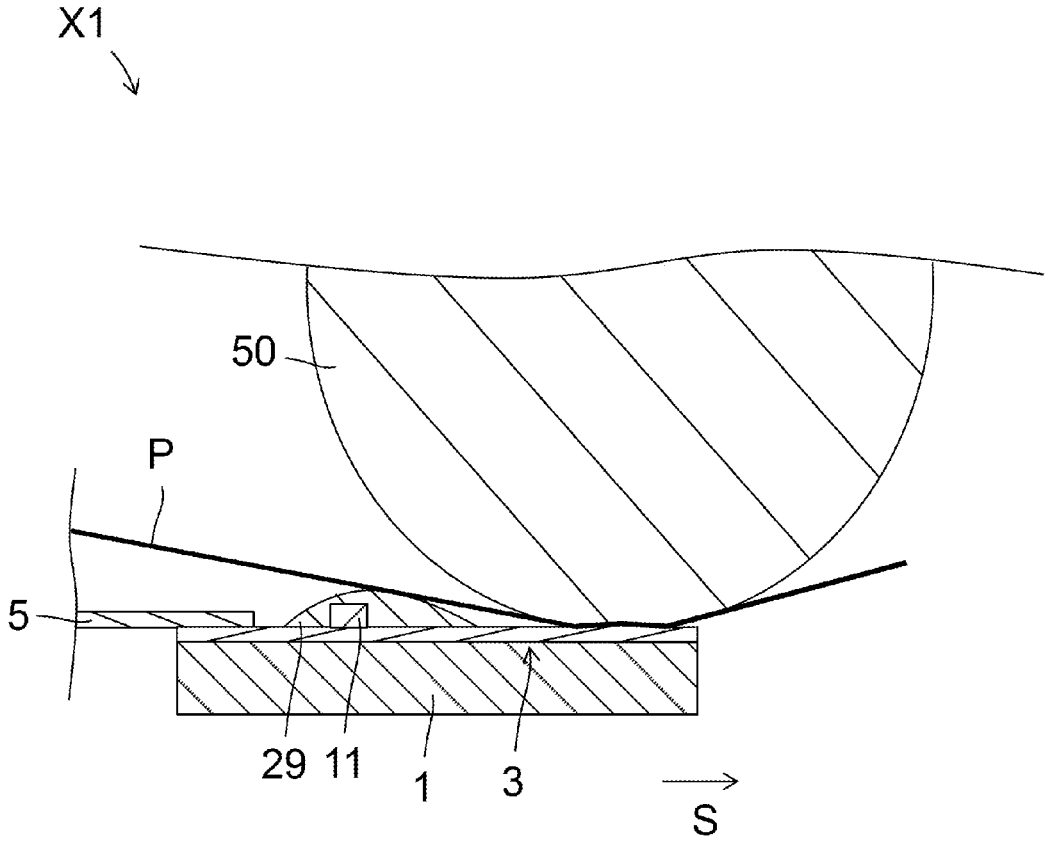
FIG. 3 is a schematic view illustrating a state in which the thermal head illustrated in FIG. 1 is performing printing.

As illustrated in FIG. 3, the recording medium P is conveyed in a conveying direction S while being in contact with a surface of the covering member 29. To be specific, as illustrated in FIG. 4(*b*), the recording medium P is conveyed on the top portion 29*a* of the covering member 29, and heat of the driver IC 11 is conducted to the recording medium P through the covering member 29 while the recording medium P is conveyed on the covering member 29.

In plan view, the thermal head X1 has a structure in which the center line L2 is located farther than the top portion 29*a* of the covering member 29 from the heat-generating portions 9. Therefore, the distance between the top portion 29*a* of the covering member 29 and the driver IC 11 can be increased.

Thus, the volume of the covering member 29 located between the driver IC 11 and the recording medium P can be increased. As a result, the probability of heat of the driver IC 11 being conducted to the recording medium P can be reduced, and the probability of occurrence of nonuniform density on the recording medium P can be reduced. Accordingly, the probability of occurrence of nonuniform density in an image printed by the thermal head X1 can be reduced.

On the thermal head X1, the recording medium P is conveyed in the conveying direction S from the driver IC 11 toward the heat-generating portions 9. Therefore, the center line L2 is disposed upstream of the top portion 29*a* of the covering member 29 in the conveying direction S. Accordingly, the probability of occurrence of nonuniform density in an image printed by the thermal head X1 can be reduced. The recording medium P may be conveyed in the opposite direction. That is, the conveying direction S of the recording medium P may be a direction from the heat-generating portions 9 toward the driver IC 11.

In the thermal head X1, the center line L1 passes through the top portion 29*a* of the covering member 29. That is, the top portion 29*a* is disposed on the center line L1. Thus, the covering member 29 has a shape that is gently curved from the top portion 29*a*, which is on the center line L1, to the first edge 29*b* and the second edge 29*c*, and the shape of the covering member 29 can be stabilized.

In plan view, the thermal head X1 has a structure in which the entirety of each driver IC 11 is located farther than the top portion 29*a* of the covering member 29 from the heat-generating portions 9. In other words, in the thermal head X1, in plan view, the driver IC 11 is not disposed below the top portion 29*a* of the covering member 29.

Therefore, the volume of the covering member 29 located below the top portion 29*a* can be increased. Thus, the probability of heat of the heat-generating portions 9, which has been conducted to the substrate 7, being conducted to the recording medium P through the covering member 29 can be reduced.

As illustrated in FIG. 4, in a cross-sectional view seen in the main scanning direction, the thermal head X1 has a structure in which, when a first distance La is defined as the distance from the center of gravity of the driver IC 11 to the top portion 29*a* and a second distance Lb is defined as the shortest distance from the center of gravity of the driver IC 11 to the surface of the covering member 29, the second distance Lb is smaller than the first distance La. That is, a portion of the surface of the covering member 29 is disposed at a distance smaller than the first distance La from the center of gravity of the driver IC 11.

Therefore, heat generated in the driver IC 11 is more easily dissipated from the surface of the covering member 29 than is conducted to the top portion 29*a*. As a result, the amount of heat conducted to the top portion 29*a* can be reduced.

The center of gravity of the driver IC 11 is equidistant from the surface of the driver IC 11 and is the center of gravity when the shape of the driver IC is regarded as a rectangular parallelepiped.

The covering member 29 can be formed by using, for example, a resin material, such as an epoxy resin or a silicone resin. As the resin material, a thermosetting resin, a thermosoftening resin, a UV curable resin, or a two-part resin can be used.

The covering member 29 can be made, for example, by using the following method.

First, the common electrode 17, the individual electrodes 19, the connection electrodes 21, and the heat-generating portions 9 are formed on the substrate 7. Next, the protective layer 25 is formed on the heat-generating portions 9 by sputtering. Next, the covering layer 27 is formed by printing. Openings (not shown), in which the driver ICs 11 are to be disposed, are formed in parts of the covering layer 27. The driver ICs 11 are disposed in the openings, and the driver ICs 11 are electrically connected to the individual electrodes 19 and the connection electrodes 21 by welding, ACF, or wire bonding.

Next, a resin material to become the covering member 29 is applied to each driver IC 11, and the resin material is dried and cured by heat, thereby forming the covering member 29. The resin material may be applied by printing by using a mask.

Next, a thermal printer Z1 will be described with reference to FIG. 5.

Figure 5:
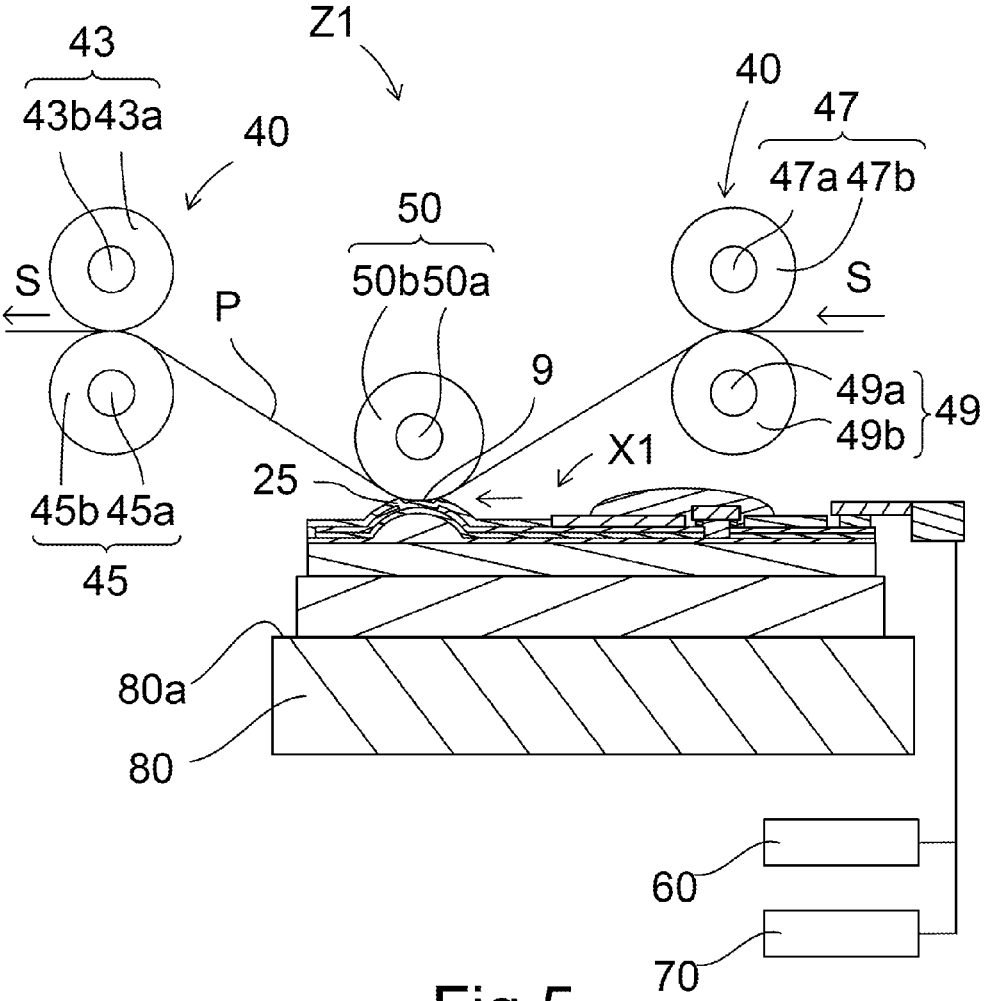
FIG. 5 is a schematic diagram illustrating the structure of a thermal printer according to the first embodiment.

As illustrated in FIG. 5, the thermal printer Z1 according to the present embodiment includes the thermal head X1 described above, a conveying mechanism 40, a platen roller 50, a power-supply device 60, and a control device 70. The thermal head X1 is mounted on a mounting surface 80*a* of a mounting member 80 disposed in a case (not shown) of the thermal printer Z1. In FIG. 5, to facilitate understanding of the structure of the thermal printer Z1, the thermal head X1 and the mounting member 80 are enlarged.

The conveying mechanism 40 includes a driving unit (not shown) and conveying rollers 43, 45, 47, and 49. The conveying mechanism 40 conveys a recording medium P, such as heat-sensitive paper or image-receiving paper onto which ink is to be transferred, in the direction S illustrated in FIG. 5 onto the protective layer 25, which is located on the plurality of heat-generating portions 9 of the thermal head X1. The driving unit has a function of driving the conveying rollers 43, 45, 47, and 49. For example, a motor can be used as the driving unit. The conveying rollers 43, 45, 47, and 49 can be formed, for example, by coating cylindrical shafts 43*a*, 45*a*, 47*a*, and 49*a*, which are made of a metal such as stainless steel, with elastic members 43*b*, 45*b*, 47*b*, and 49*b*, which are made of butadiene rubber or the like. Although not illustrated, if the recording medium P is image-receiving paper or the like onto which ink is to be transferred, an ink film is conveyed together with the recording medium P to a space between the recording medium P and the heat-generating portions 9 of the thermal head X1.

The platen roller 50 has a function of pressing the recording medium P against the protective layer 25 located on the heat-generating portions 9 of the thermal head X1. The platen roller 50 is disposed so as to extend in a direction perpendicular to the conveying direction S of the recording medium P. Both ends of the platen roller 50 are supported so that the platen roller 50 can rotate while pressing the recording medium P against the heat-generating portions 9. The platen roller 50 can be formed, for example, by coating a cylindrical shaft 50*a* made of a metal such as stainless steel with an elastic member 50*b* made of butadiene rubber or the like.

The power-supply device 60 has a function of supplying an electric current for causing the heat-generating portions 9 of the thermal head X1 to generate heat and an electric current for operating the driver ICs 11. The control device 70 has a function of supplying a control signal, for controlling the operation of the driver ICs 11, to the driver ICs 11 to selectively cause the heat-generating portions 9 of the thermal head X1 to generate heat as described above.

As illustrated in FIG. 5, the thermal printer Z1 performs a predetermined printing operation on the recording medium P by selectively causing the heat-generating portions 9 to generate heat by using the power-supply device 60 and the control device 70 while pressing the recording medium P against the heat-generating portions 9 of the thermal head X1 by using the platen roller 50 and conveying the recording medium P onto the heat-generating portions 9 by using the conveying mechanism 40. If the recording medium P is image-receiving paper or the like, printing on the recording medium P is performed by thermally transferring ink of an ink film (not shown) conveyed together with the recording medium P to the recording medium P.

Second Embodiment

Figure 6:
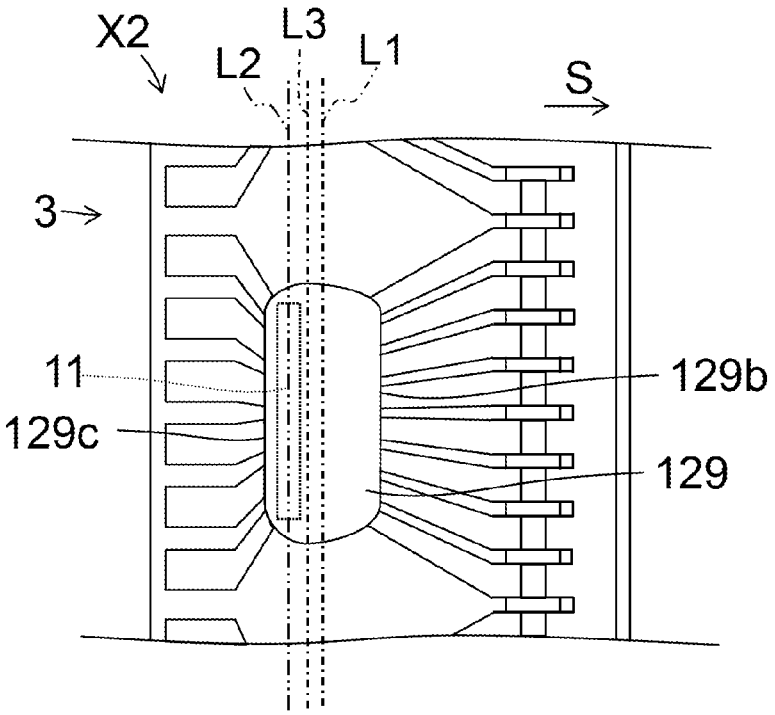
FIGS. 6(*a*) and 6(*b*) illustrate a thermal head according to a second embodiment, FIG. 6(*a*) is an enlarged plan view of the vicinity of a covering member, and FIG. 6(*b*) is a cross-sectional view illustrating a state in which a recording medium is in contact with the covering member during printing.
Figure 6:
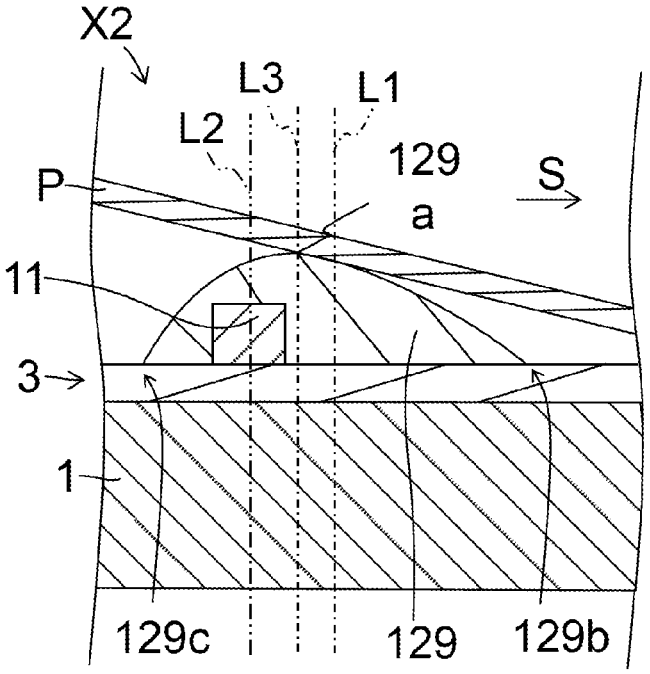

Referring to FIG. 6, a thermal head X2 will be described. The thermal head X2 includes a covering member 129, which differs from the covering member 29 of the thermal head X1. Hereinafter, the same members will be denoted by the same numerals.

The covering member 129 has a structure in which the center line L1 does not pass through a top portion 129*a*, and a perpendicular line L3 that passes through the top portion 129*a* (hereinafter referred to as "the perpendicular line L3") is located at a position different from that of the center line L1. As illustrated in FIG. 6(*b*), the perpendicular line L3, passing through the top portion 129*a*, is located at a position farther than the center line L1 from the heat-generating portions 9. As a result, in the thermal head X2, in plan view, the top portion 129*a* of the covering member 129 is located farther than the center line L1 from the heat-generating portions 9.

Therefore, the position at which the recording medium P and the covering member 129 contact each other can be disposed upstream in the conveying direction S. Thus, it takes a certain time for the recording medium P to be conveyed onto the heat-generating portions 9, and therefore heat can be dissipated while the recording medium P is conveyed. As a result, the probability of occurrence of nonuniform density in an image on a recording medium printed by the thermal head X2 can be reduced.

In the thermal head X2, the center line L2 is located at a position farther than the perpendicular line L3 from the heat-generating portions 9. Therefore, the probability of heat of the driver IC 11 being conducted to the recording medium P can be further reduced.

That is, in the thermal head X2, the perpendicular line L3 is disposed at a position farther than the center line L1 from the heat-generating portions 9, and the center line L2 is disposed at a position farther than the perpendicular line L3, passing through the top portion 129*a*, from the heat-generating portions 9. As a result, the covering member 129 and the recording medium P can be made to contact each other on the perpendicular line L3, which is located upstream of the center line L1 in the conveying direction S. Moreover, the driver IC 11 can be disposed upstream, in the conveying direction S, of a contact point at which the covering member 129 and the recording medium P contact each other. As a result, the probability of occurrence of nonuniform density in an image printed by the thermal head X2 can be further reduced.

In plan view, the center line L2 may be disposed between the center line L1 and the perpendicular line L3. Also in this case, conduction of heat from the driver IC 11 to the recording medium P can be suppressed.

Third Embodiment

Figure 7:
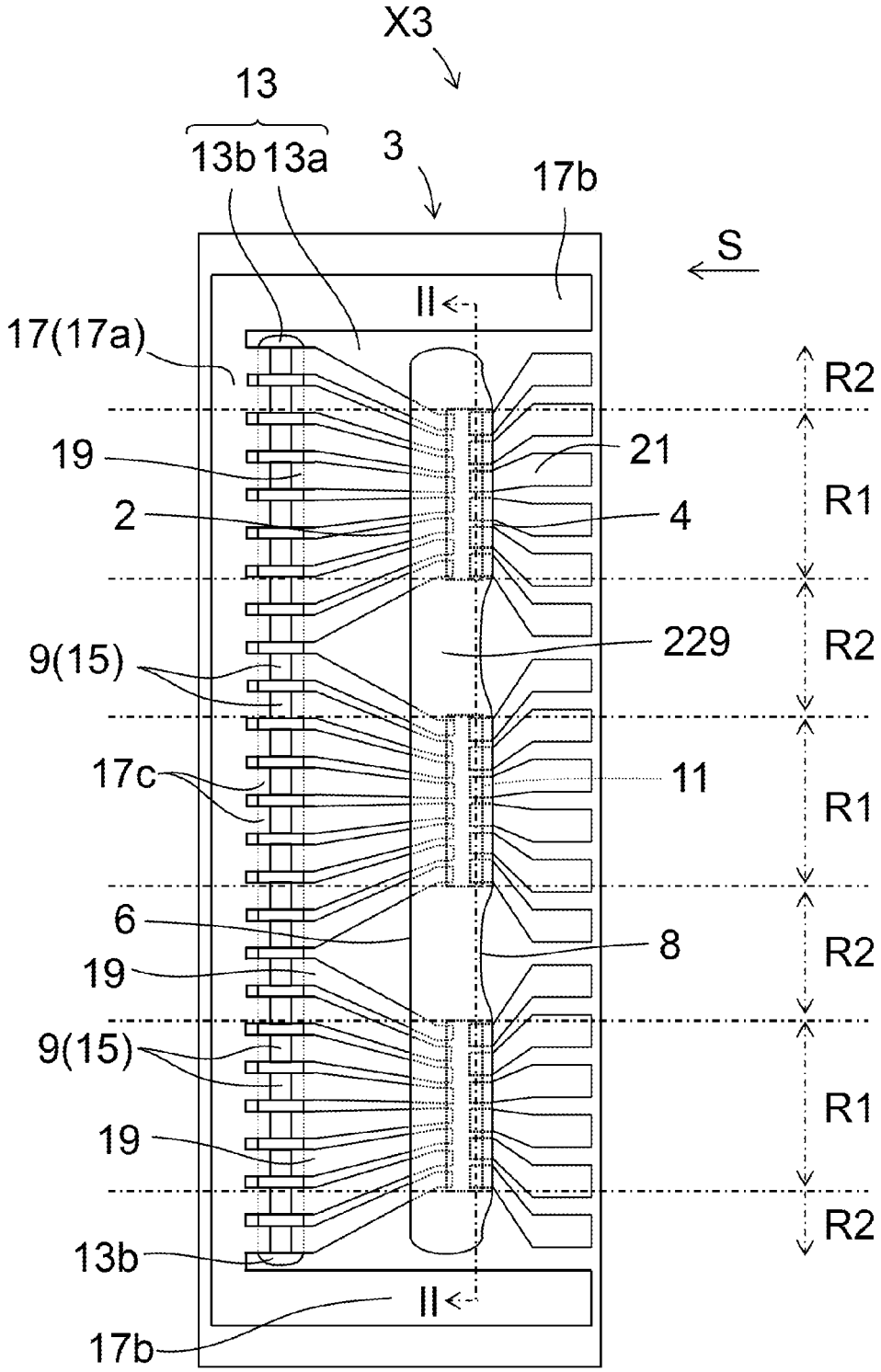
FIG. 7 is a plan view of a head base body of a thermal head according to a third embodiment.
Figure 8:
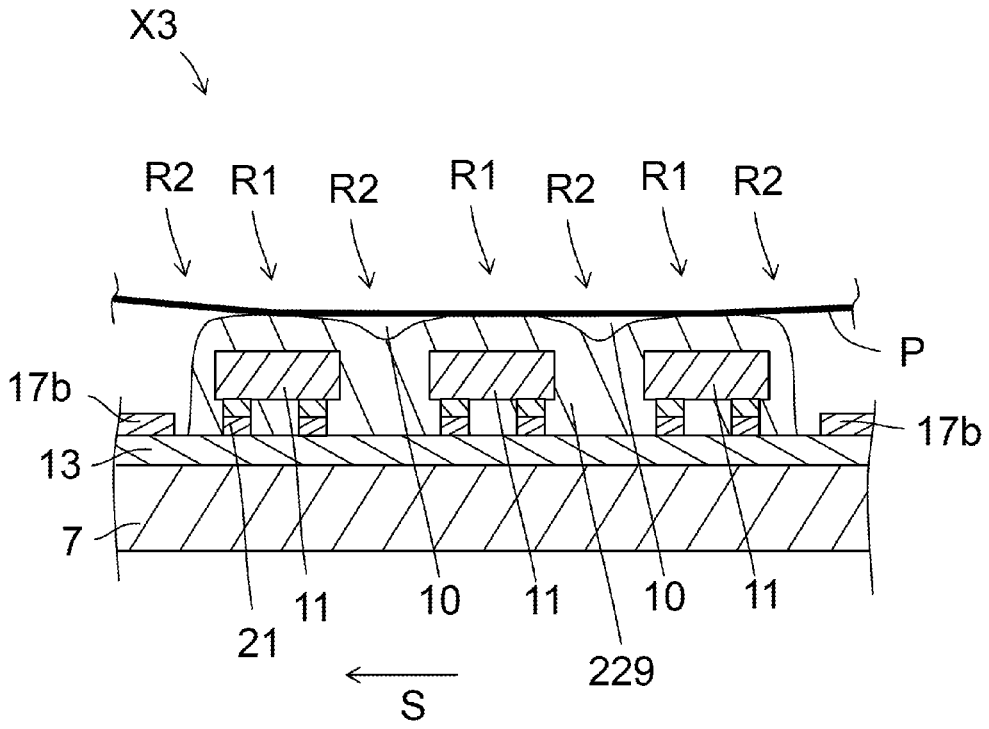
FIG. 8 is a cross-sectional view taken along line II-II of FIG. 7.

Referring to FIGS. 7 and 8, a thermal head X3 will be described.

In the thermal head X3, a covering member 229 is integrally disposed on the plurality of driver ICs 11. The covering member 229 includes first regions R1 in which the driver ICs 11 exist in the cross direction of the main scanning direction and second regions R2 in which the driver ICs 11 do not exist in the cross direction of the main scanning direction. In other words, the covering member includes the first regions R1 in which the driver ICs 11 exist when seen in the conveying direction S, which is the sub-scanning direction, and the second regions R2 in which the driver ICs 11 do not exist when seen in the sub-scanning direction S. The first regions R1 and the second regions R2 extend in the sub-scanning direction.

The covering member 229 includes first edges 2 and second edges 4 in the first regions R1 and includes first edges 6 and second edges 8 in the second regions R2. The first edges 2 of the first regions R1 are continuous with the first edges 6 of the second regions R2. The second edges 4 of the first regions R1 are continuous with the second edges 8 of the second regions R2.

In the thermal head X3, the covering member 229 has a structure in which the second edges 8 of the second regions R2 are located closer than the second edges 4 of the first regions R1 to the heat-generating portions 9. Therefore, a contact state in which the covering member 229 and the recording medium P are in contact with each other varies in the main scanning direction.

That is, as the recording medium P is conveyed, the contact state changes from a state in which the recording medium P is in contact with only the first regions R1 to a state in which the recording medium P is in contact with the first regions R1 and the second regions R2. As a result, the covering member 229 functions to remove a crease from the recording medium P, and the thermal head X3 can perform precise printing.

As illustrated in FIG. 8, in the thermal head X3, the height of the covering member 229 of the first regions R1 from the substrate 7 is larger than the height of the covering member 229 of the second regions R2 from the substrate 7.

Therefore, when the recording medium P is conveyed onto the covering member 229, gaps 10 are generated between the covering member 229 of the second regions R2 and the recording medium P. Thus, the recording medium P is conveyed on the covering member 229 in a state in which the gaps 10 are formed thereon. As a result, the contact area between the recording medium P and the covering member 229 can be reduced, and the probability of occurrence of sticking of the recording medium P can be reduced.

In the thermal head X3, the covering member 229 has a shape such that the distance between the first edges 2 of the first regions R1 and the heat-generating portions 9 is substantially the same as the distance between the first edges 6 of the second regions R2 and the heat-generating portions 9. Therefore, the first edges 2 of the first region R1 and the first edges 6 of the second region R2 are arranged along a substantially straight line in the main scanning direction.

As a result, the recording medium P, which has been conveyed on the covering member 229, is removed from the covering member 229 in a state in which the recording medium P extends uniformly in the main scanning direction, and the recording medium P can be conveyed to the heat-generating portions 9 in a state in which the recording medium P extends uniformly in the main scanning direction. In particular, this is effective when conveying a recording medium P having a low rigidity.

The sentence "the distance between the first edges 2 of the first regions R1 and the heat-generating portions 9 is substantially the same as the distance between the first edges 6 of the second regions R2 and the heat-generating portions 9" means that, including a manufacturing error, the distance between the first edges 2 of the first regions R1 and the heat-generating portions 9 is in the range of 0.95 to 1.05 times the distance between the first edges 6 of the second regions R2 and the heat-generating portions 9.

The thermal head X3 can be made, for example, by using the following method. As with the thermal head X1, after disposing the driver ICs 11 on the head base body 3, the covering member 229 can be made by applying a resin material, to become the covering member 229, by using a dispenser and curing the resin material by heat.

At this time, the nozzle positions of the dispenser for applying the resin material of the covering member 229 are disposed closer than the driver IC 11 to the heat-generating portions 9 so that the driver ICs 11 are disposed at positions farther than the center of the covering member 229 from the heat-generating portions 9. Moreover, the amount of the resin material applied to the first regions R1 is made larger than the amount of the resin material applied to the second regions R2.

The covering member 229 can be made by using the method described above. The nozzle positions of the dispenser for forming the second regions R2 may differ from those for forming the first regions R1. For example, the thermal head X3 may be made by disposing the nozzle positions of the dispenser for forming the second regions R2 closer than those for forming the first regions R1 to the heat-generating portions 9. Instead of using a dispenser, the covering member 229 may be made by printing by using a mask.

The distance between the first edges 2 of the first regions R1 and the heat-generating portions 9 need not be substantially the same as the distance between the first edges 6 of the second regions R2 and the heat-generating portions 9. The height of the covering member 229 of the first regions R1 from the substrate 7 need not be larger than the height of the covering member 229 of the second regions R2 from the substrate 7.

Fourth Embodiment

Figure 9:
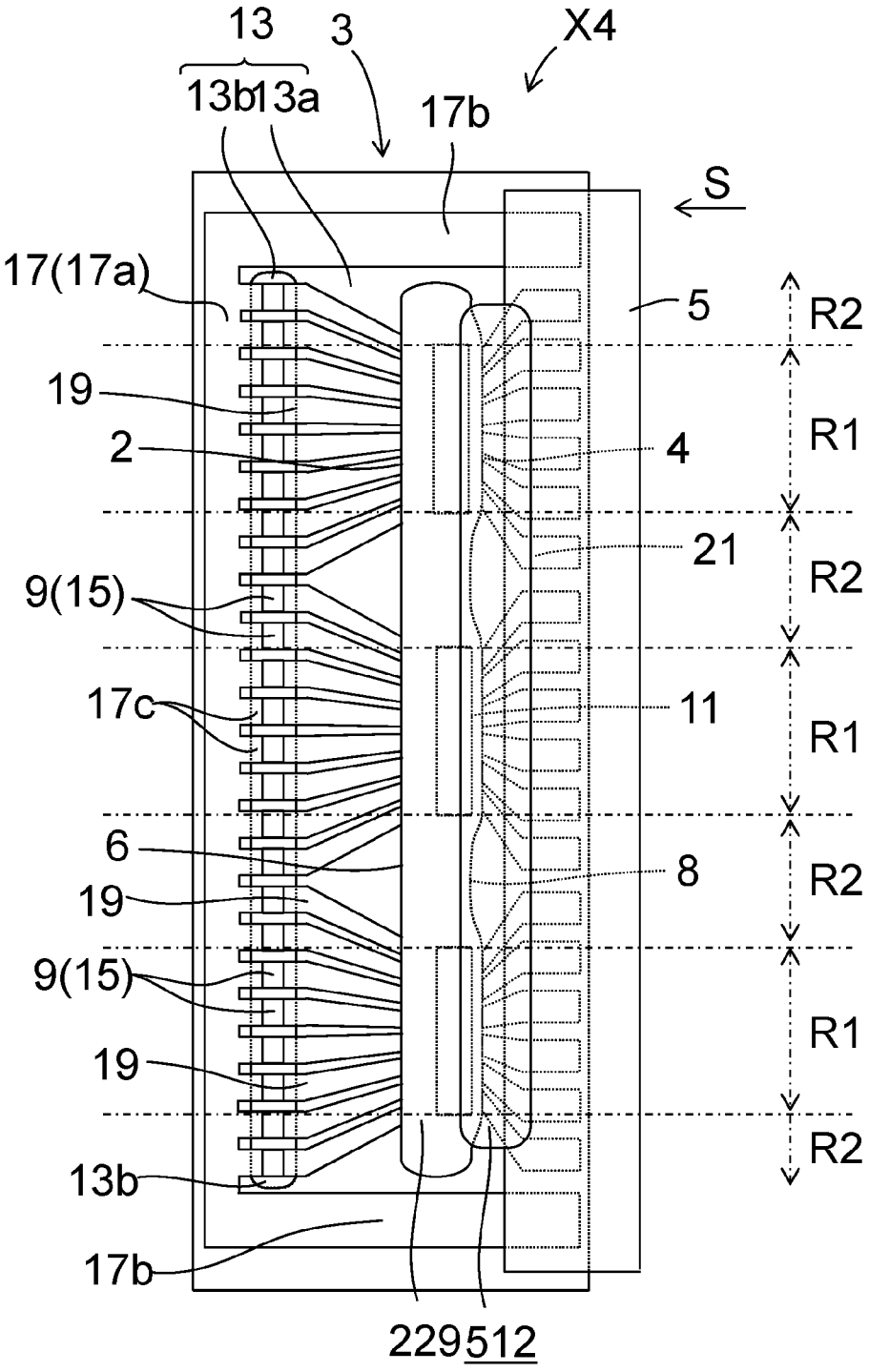
FIG. 9 is a plan view of a thermal head according to a fourth embodiment.

Referring to FIG. 9, a thermal head X4 will be described. In the thermal head X4, the FPC 5 is disposed adjacent to the second edges 4 and 8 of the covering member 229, and a resin layer 512 is disposed on the FPC 5 and the second edges 4 and 8 so as to extend from the FPC 5 to the second edges 4 and 8. In other respects, the thermal head X4 is the same as the thermal head X3.

The resin layer 512 is provided in order to increase the strength of bond between the head base body 3 and the FPC 5. In particular, the resin layer 512 increases the strength of bond between the head base body 3 and the FPC 5 in the thickness direction of the head base body 3. The resin layer 512 can be made from a resin layer material, such as an epoxy resin or a silicone resin. A thermosetting resin, a thermosoftening resin, a UV curable resin, or a two-part resin can be used as the resin layer material.

The thermal head X4 has a structure in which the second edges 8 of the second regions R2 are located closer to the heat-generating portions 9 than the second edges 4 of the first regions R1 and the resin layer 512 is disposed on the FPC 5 and the second edges 4 and 8 so as to extend from the FPC 5 to the second edges 4 and 8. Therefore, when applying a resin layer material to from the resin layer 512, surplus of the resin layer material flows into gaps between the second edges 8 of the second regions R2 and the FPC 5. As a result, the probability of the resin layer material flowing out of the thermal head X4 can be reduced.

In particular, if the resin layer material has surplus in a central region in the main scanning direction, the surplus may flow onto the FPC 5. However, with the thermal head X4, the surplus resin layer material can flow into the gaps between the second edges 8 of the second regions R2 and the FPC 5.

Fifth Embodiment

Figure 10:
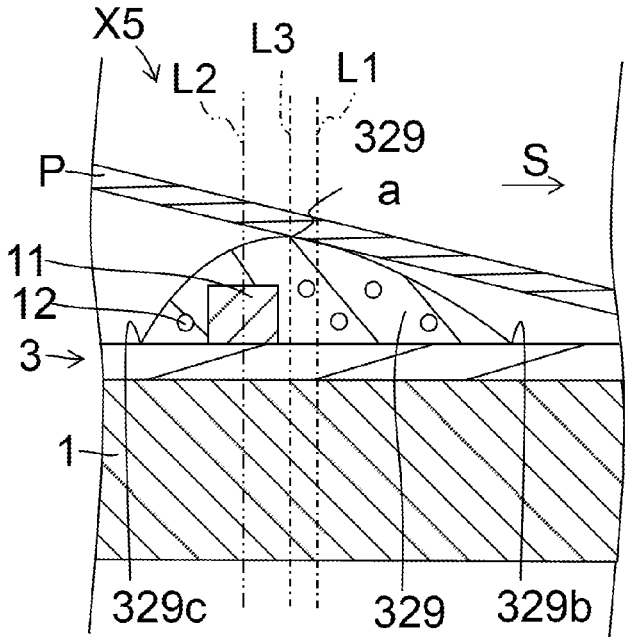
FIG. 10(*a*) is a cross-sectional view illustrating a state in which a recording medium is in contact with a covering member of a thermal head according to a fifth embodiment during printing, and FIG. 10(*b*) is a sectional view illustrating a state in which a recording medium is in contact with a covering member of a thermal head according to a modification of the thermal head of FIG. 10(*a*) during printing.
Figure 10:
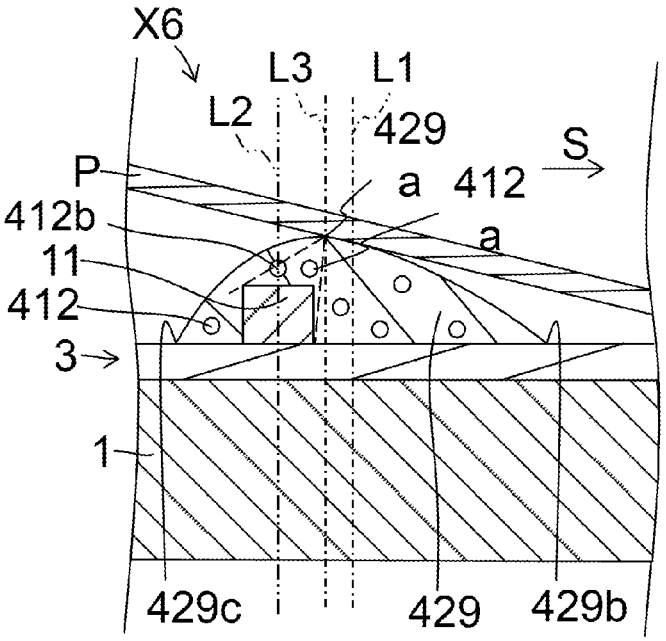

Referring to FIG. 10, a thermal head X5 and a thermal head X6, which is a modification of the thermal head X5, will be described. In FIG. 10(*b*), a tangent line to the driver IC 11 extending from a top portion 429*a* is represented by a broken line.

In the thermal head X5, a covering member 329 includes a plurality of bubbles 412*a*. In other respects, the thermal head X5 is the same as the thermal head X2. The thermal head X6, which is a modification, differs from the thermal head X5 in the disposition of bubbles 412*a* formed therein.

In the thermal head X5, the covering member 329 includes the plurality of bubbles 12. Therefore, the thermal conductivity of the covering member 329 can be reduced, and heat of the driver IC 11 is not easily conducted in the covering member 329. As a result, the probability of heat of the driver IC 11 being conducted to the recording medium P can be reduced, and the probability of occurrence of non-uniform density in an image printed by the thermal head X5 can be reduced.

The thermal head X6 includes the plurality of bubbles 412 in a covering member 429, and some of the bubbles 412 (bubbles 412*a*) are disposed between the driver IC 11 and the top portion 429*a*. Therefore, the bubbles 12 function as a heat-insulating layer between the driver IC 11 and the top portion 429*a*, and heat of the driver IC 11 is not easily conducted to the top portion 429*a*. As a result, the probability of occurrence of nonuniform density in an image printed by the thermal head X6 can be reduced.

The sentence "the bubbles 412 are located between the top portion 429*a* and the driver IC 11" means that the bubbles 412*a* and 412*b* are included in the covering member 429 located in a region (hereinafter, referred to as "the region") surrounded by the top portion 429*a* and the tangent line of the driver IC 11 extending from the top portion 429*a*. The entirety of the bubble 412*b* need not be disposed in the region as in the case of the bubble 412*b*, and it is sufficient that a part of the bubble 412*b* is disposed in the region.

The thermal heads X5 and X6 can be made, for example, by using the following method. When using a two-liquid thermosetting resin to form the covering members 329 and 429, the covering members 329 and 429 including the bubbles 12 and 412 can be formed by increasing the viscosity of each of a base resin and a curing agent and by agitating the base resin and the curing agent in the highly viscos state.

A resin material of the covering members 329 and 429 may include a foaming agent. The surface of the driver IC 11 may be treated so that the bubbles 12 and 412 can be formed around the driver IC 11.

Sixth Embodiment

Figure 11:
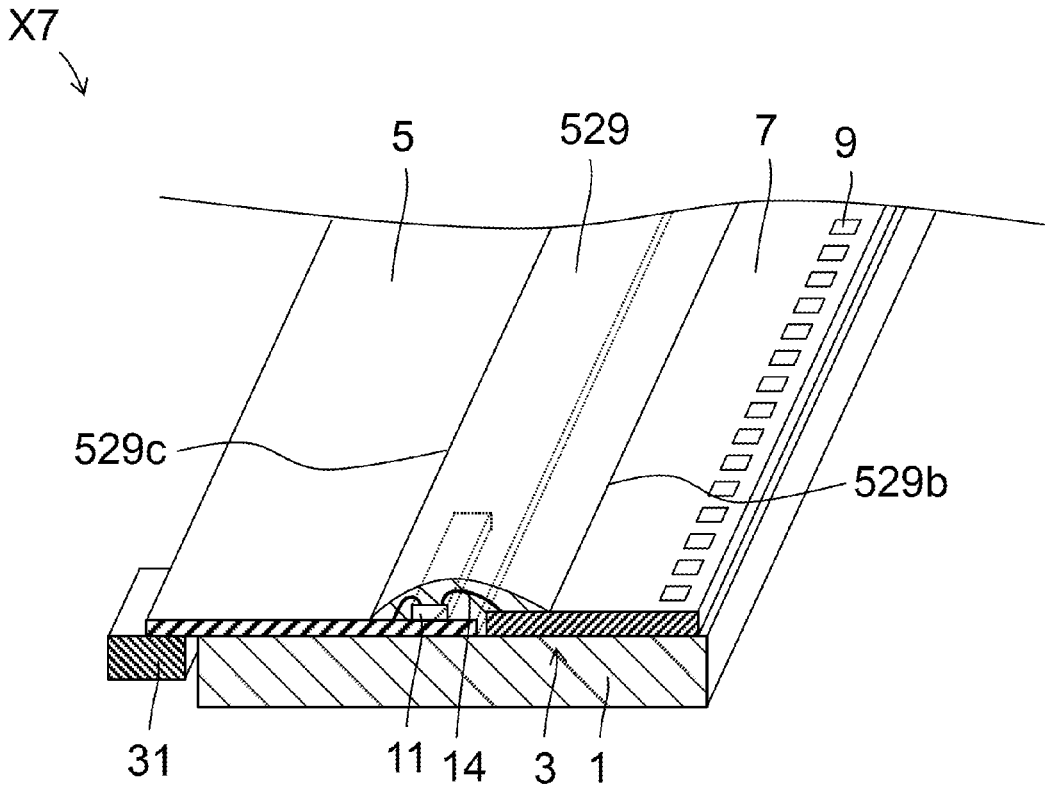
FIG. 11 is a cross-sectional perspective view of a thermal head according to a seventh embodiment.
Figure 12:
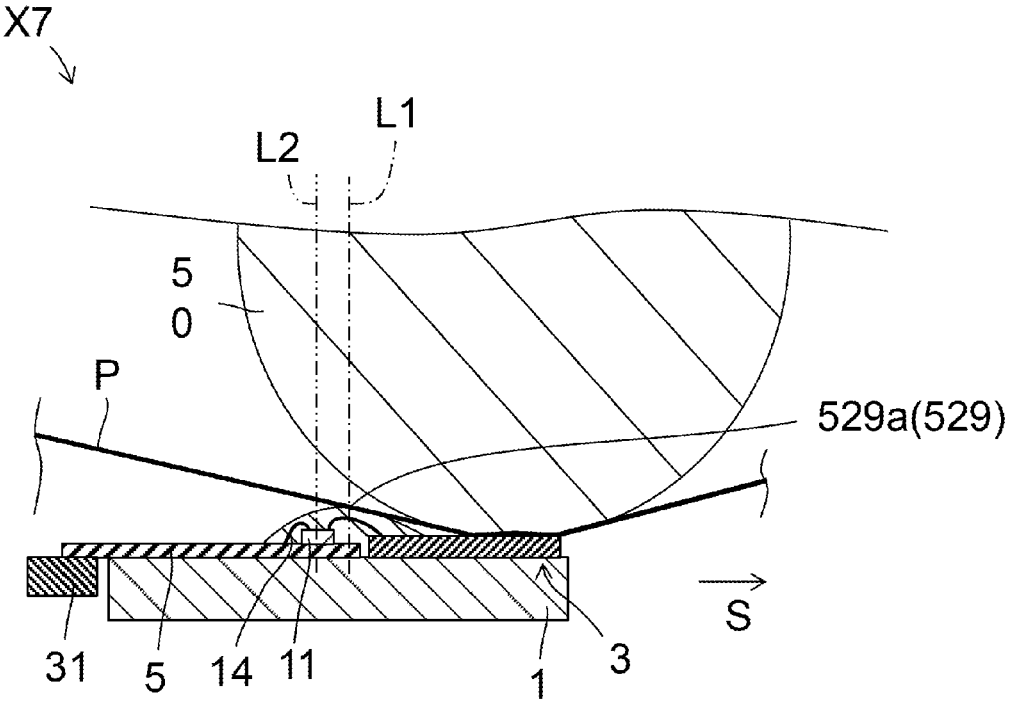
FIG. 12 is a schematic view illustrating a state in which the thermal head illustrate in FIG. 11 is performing printing.

Referring to FIGS. 11 and 12, a thermal head X7 will be described.

The thermal head X7 includes a heat sink 1, a head base body 3, an FPC 5, and a connector 31. The head base body 3 is disposed on the heat sink 1. The FPC 5 is disposed adjacent to the head base body 3 on the heat sink 1. The connector 31 is disposed below the FPC 5 adjacent to the heat sink 1.

The driver IC 11 is disposed on the FPC 5. Terminals (not shown) of the driver IC 11 are connected, through a plurality of wires 14, to printed wires (not shown) of the FPC 5 or to connection electrodes (not shown) of the head base body 3. Although not illustrated in the figures, as in the thermal head X1, a plurality of the driver ICs 11 are arranged in the main scanning direction.

A covering member 529 is disposed on the plurality of driver ICs 11 so as to extend in the main scanning direction. The covering member 529 is disposed on the FPC 5 and the head base body 3 so as to extend from the FPC 5 to the head base body 3. Therefore, a first edge 529*b* is disposed on the head base body 3, and a second edge 529*c* is disposed on the FPC 5.

As illustrated in FIG. 12, in the thermal head X7, in plan view, the driver IC 11 is located farther than a top portion 529*a* of the covering member 529 from the heat-generating portions 9. Therefore, the distance between the top portion 529*a* of the covering member 529 and the driver IC 11 can be increased.

Thus, the amount of the covering member 529 disposed between the driver IC 11 and the recording medium P can be increased. As a result, the probability of heat of the driver IC 11 being conducted to the recording medium P can be reduced, and the probability of occurrence of nonuniform density in an image printed by the thermal head X7 can be reduced.

Seventh Embodiment

Figure 13A:
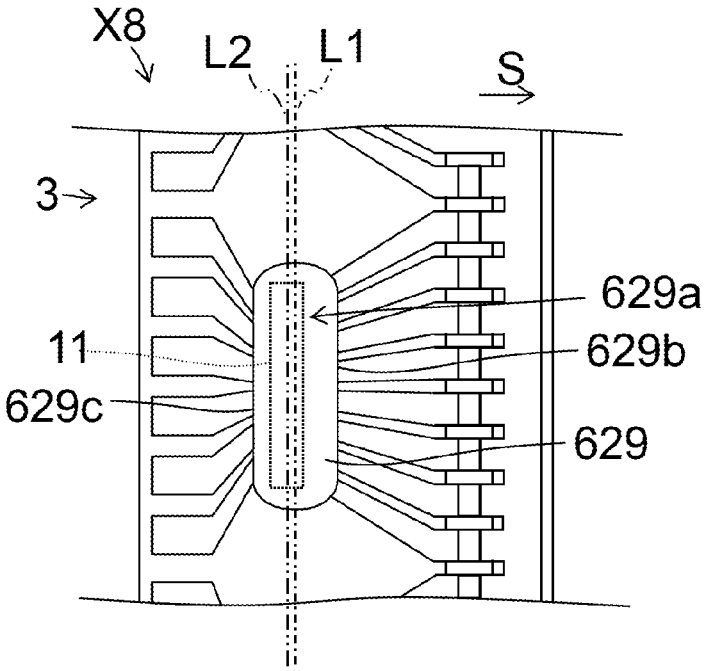
FIGS. 13(*a*) and 13(*b*) illustrate a thermal head according to an eighth embodiment, FIG. 13(*a*) is an enlarged plan view of the vicinity of a covering member, and FIG. 13(*b*) is a cross-sectional view illustrating a state in which a recording medium is in contact with the covering member during printing.
Figure 13B:
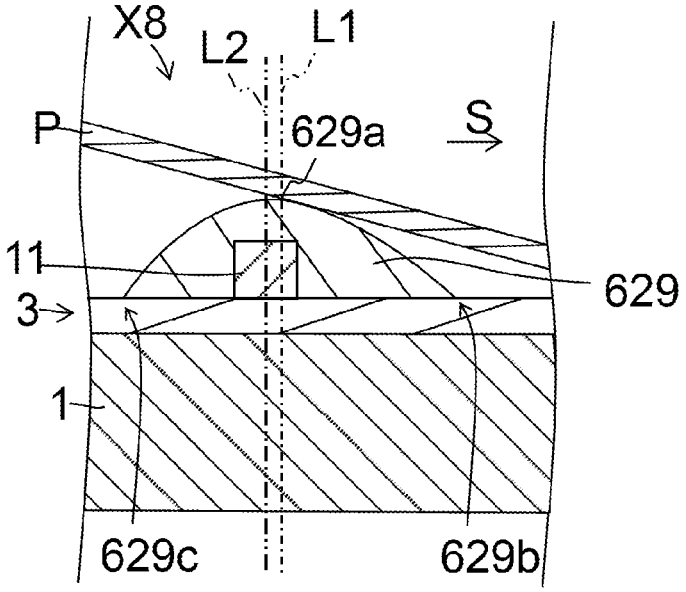

Referring to FIG. 13, a thermal head X8 will be described.

The thermal head X8 differs from the thermal head X1 in the disposition of the driver IC 11 in a covering member 629. Other parts of the thermal head X8 are the same as those the thermal head X1, and description of such parts will be omitted.

In plan view, the thermal head X8 has a structure in which the center line L2 is disposed farther than the center line L1 from the heat-generating portions 9 and a part of the driver IC 11 is disposed below a top portion 629*a*. That is, the thermal head X8 has a structure in which the distance between the center line L1 and the center line L2 in the sub-scanning direction is smaller than the distance from the center of gravity of the driver IC 11 to the surface of the driver IC 11.

Also in this case, the volume of the covering member 629 disposed between the driver IC 11 and the recording medium P can be increased. As a result, the probability of heat of the driver IC 11 being conducted to the recording medium P can be reduced, and the probability of occurrence of nonuniform density in an image printed by the thermal head X8 can be reduced.

Thus, as long as the center line L2 is located farther than the top portion 629*a* of the covering member 629 from the heat-generating portions 9, the probability of occurrence of nonuniform density in an image printed by the thermal head X8 can be reduced. That is, it is sufficient that more than 50% of the driver IC 11 is located farther than the top portion 29*a* of the covering member 29 from the heat-generating portions 9.

The present invention is not limited to the embodiments described above, and the embodiments may be modified in various ways within the spirit and scope of the present invention. For example, the thermal printer Z1 described above includes the thermal head X1 according to the first embodiment. The thermal printer Z1 is not limited thereto, and the thermal printer Z1 may include any one of the thermal heads X2 to X8. A combination of the thermal heads X1 to X8 according to the embodiments may be used, and such embodiments are assumed to be described in the present description. That is, features of the thermal heads X1 to X6 and X8 and features of the thermal head X7, in which the driver IC 11 is disposed on the FPC 5, may be used in combination.

It is not necessary that the center lines L2 of all of the driver ICs 11 mounted in the thermal head X1 be disposed farther than the top portion 29*a* from the heat-generating portions 9. That is, the center lines L2 of some of the driver ICs 11 mounted in the thermal head X1 need not be disposed farther than the top portion 29*a* from the heat-generating portions 9. It sufficient that the center lines L2 of 60% or more of the driver ICs 11 mounted in the thermal head X1 are disposed farther than the top portion 29*a* from the heat-generating portions 9. Also in this case, the probability of occurrence of nonuniform density in an image printed by the thermal head X1 can be reduced.

In order to reduce the probability of occurrence of nonuniform density in an image printed by the thermal head X1, it is most preferable that all of the driver ICs 11 mounted in the thermal head X1 are disposed farther than the top portion 29*a* of the covering member 29 from the heat-generating portions 9.

In the thermal head X1, the heat storage layer 13 includes the protruding portion 13*b*, and the electrically resistive layer 15 is disposed on the protruding portion 13*b*. However, the structure is not limited thereto. For example, without providing the protruding portion 13*b* in the heat storage layer 13, the heat-generating portions 9 of the electrically resistive layer 15 may be disposed on the base 13*a* of the heat storage layer 13. Alternatively, without forming the heat storage layer 13, the electrically resistive layer 15 may be disposed on the substrate 7.

In the thermal head X1, the common electrode 17 and the individual electrodes 19 are disposed on the electrically resistive layer 15. However, the structure is not limited thereto as long as both of the common electrode 17 and the individual electrodes 19 are connected to the heat-generating portions 9 (the electrically resistive layer 15). For example, the common electrode 17 and the individual electrodes 19 may be disposed on the heat storage layer 13, and the electrically resistive layer 15 may be formed only in a region between the common electrode 17 and the individual electrodes 19 to form the heat-generating portions 9.

The thermal heads X1 to X8 are planar heads in which the heat-generating portions 9 are disposed on the main surface of the substrate 7. However, the present invention may be applied to a real-edge-type head in which the heat-generating portions 9 are disposed on an end surface of the substrate 7. In the example described above, the head base body 3 is electrically connected to the outside through the FPC 5. However, the connector 31 may be directly electrically connected to the head base body 3. Thin-film heads including the heat-generating portions 9, which are formed by using a thin-film forming technology, have been described above. However, the present invention may be applied to a thick-film head including heat-generating portions 9 formed by using a thick-film forming technology.

REFERENCE SIGNS LIST

X1 to X8 thermal head
Z1 thermal printer
R1 first region
R2 second region
S conveying direction (sub-scanning direction)
1 heat sink
2 first edge of first region
3 head base body
4 second edge of first region
5 flexible printed circuit board
6 first edge of second region
7 substrate
8 second edge of second region
9 heat-generating portion
11 driver IC
12 bubble
13 heat storage layer
15 electrically resistive layer
17 common electrode
19 individual electrode
21 connection electrode

23 bonding material
25 protective layer
27 covering layer
29, 129, 229, 329, 429, 529, 629 covering member
29*a*, 129*a*, 229*a*, 329*a*, 429*a*, 529*a*, 629*a* top portion
29*b*, 129*b*, 229*b*, 329*b*, 429*b*, 529*b*, 629*b* first edge
29*c*, 129*c*, 229*c*, 329*c*, 429*c*, 529*c*, 629*c* second edge
412 resin layer

The invention claimed is:

1. A thermal head comprising:
a substrate;
a heat-generating portion disposed on the substrate;
an electrode disposed on the substrate and electrically connected to the heat-generating portion;
a driver IC disposed on the substrate and electrically connected to the electrode; and
a covering member covering the driver IC,
wherein, in plan view, a center line of the driver IC extending in a main scanning direction and a highest position of the covering member are located farther from the heat-generating portion than a center line of the covering member extending in the main scanning direction.

2. The thermal head according to claim 1,
wherein, in plan view, an entirety of the driver IC is located farther from the heat-generating portion than the highest position of the covering member.

3. The thermal head according to claim 1,
wherein, in plan view, the highest position of the covering member is located farther from the heat generating portion than the center line of the covering member extending in the main scanning direction.

4. The thermal head according to claim 1,
wherein the covering member includes a bubble.

5. The thermal head according to claim 4,
wherein the bubble is disposed between the highest position of the covering member and the driver IC.

6. The thermal head according to claim 1,
wherein the covering member includes a first region in which the driver IC is located in a cross direction of the main scanning direction and a second region in which the driver IC is not located in the cross direction of the main scanning direction, and an each of the first region and the second region includes a first edge disposed close to the heat-generating portion and a second edge located opposite to the first edge, and
wherein a second edge of the second region is located closer to the heat-generating portion than a second edge of the first region.

7. The thermal head according to claim 6,
wherein a distance between a first edge of the first region and the heat-generating portion is substantially equal to a distance between a first edge of the second region and the heat-generating portion.

8. The thermal head according to claim 6, further comprising:
a circuit board electrically connected to the electrode,
wherein the circuit board is disposed adjacent to an each second edge of the first region and the second region, and
wherein a resin layer is disposed on a part of the circuit board and a part of the each second edge of the first region and the second region.

9. A thermal printer comprising:
the thermal head according to claim 1;
a conveying mechanism that conveys a recording medium onto the heat-generating portion; and
a platen roller that presses the recording medium against the heat-generating portion.

10. The thermal head according to claim 1,
wherein the center line of the driver IC extending in the cross direction of the main scanning direction is located farther from the heat-generating portion than the highest position of the covering member.

11. A thermal head comprising:
a substrate;
a heat-generating portion disposed on the substrate;
an electrode disposed on the substrate and electrically connected to the heat-generating portion;
a circuit board electrically connected to the electrode;
a driver IC disposed on the circuit board and electrically connected to the electrode; and
a covering member covering the driver IC,
wherein, in plan view, a center line of the driver IC extending in a main scanning direction is located farther from the heat-generating portion than a center line of the covering member extending in the main scanning direction.

12. The thermal head according to claim 11,
wherein, in plan view, an entirety of the driver IC is located farther from the heat-generating portion than the highest position of the covering member.

13. The thermal head according to claim 11,
wherein, in plan view, the highest position of the covering member is located farther from the heat generating portion than a center line of the covering member, extending in the main scanning direction.

14. The thermal head according to claim 11, wherein the covering member includes a bubble.

15. The thermal head according to claim 14,
wherein the bubble is disposed between the highest position of the covering member and the driver IC.

16. The thermal head according to claim 11,
wherein the covering member includes a first region in which the driver IC is located in a cross direction of the main scanning direction and a second region in which the driver IC is not located in the cross direction of the main scanning direction, and an each of the first region and the second region includes a first edge disposed close to the heat-generating portion and a second edge located opposite to the first edge, and
wherein a second edge of the second region is located closer to the heat-generating portion than a second edge of the first region.

17. The thermal head according to claim 16,
wherein a distance between a first edge of the first region and the heat-generating portion is substantially equal to a distance between a first edge of the second region and the heat-generating portion.

18. The thermal head according to claim 16,
wherein the circuit board is disposed adjacent to an each second edge of the first region and the second region, and
wherein a resin layer is disposed on a part of the circuit board and a part of the each second edge of the first region and the second region edge.

19. The thermal head according to claim 11,
wherein the center line of the driver IC extending in the main scanning direction is located farther from the heat-generating portion than the highest position of the covering member.

20. The thermal head according to claim 11, wherein the highest position of the cover member is located farther from the heat-generating portion than the center line of the covering member in the main scanning direction.

* * * * *